US009741509B2

(12) United States Patent
Kibiti et al.

(10) Patent No.: US 9,741,509 B2
(45) Date of Patent: Aug. 22, 2017

(54) SLIDE INPUT COMPONENT ASSEMBLIES OF AN ELECTRONIC DEVICE AND METHODS FOR MAKING THE SAME

(71) Applicant: Apple Inc., Cupertino, CA (US)

(72) Inventors: Elvis M. Kibiti, Meru (KE); Luen-Chiou Lin, Cupertino, CA (US); Sean S. Corbin, Cupertino, CA (US); Shih-Ning Kao, Cupertino, CA (US); Stephen R. McClure, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 157 days.

(21) Appl. No.: 13/656,368

(22) Filed: Oct. 19, 2012

(65) Prior Publication Data

US 2014/0110231 A1 Apr. 24, 2014

(51) Int. Cl.

| | |
|---|---|
| ***H01H 15/10*** | (2006.01) |
| ***H01H 15/04*** | (2006.01) |
| ***H01H 11/00*** | (2006.01) |
| *H01H 9/16* | (2006.01) |
| *H01H 15/24* | (2006.01) |

(52) U.S. Cl.

CPC ..... *H01H 15/04* (2013.01); *H01H 11/00* (2013.01); *H01H 15/10* (2013.01); *H01H 9/16* (2013.01); *H01H 15/24* (2013.01); *Y10T 29/49105* (2015.01)

(58) Field of Classification Search

CPC .. H01H 13/14; H01H 2221/014; H01H 15/10; H01H 15/24

USPC ..... 200/293, 333, 547–551, 329, 341, 345

See application file for complete search history.

(56) References Cited

U.S. PATENT DOCUMENTS

| | | | | |
|---|---|---|---|---|
| 3,674,953 | A | 7/1972 | Brevick | |
| 3,729,600 | A | 4/1973 | Solomon et al. | |
| 5,998,747 | A * | 12/1999 | Kelso et al. | 200/331 |
| 6,621,018 | B1 * | 9/2003 | Chen | 200/16 C |
| 8,143,545 | B2 * | 3/2012 | Zuo | H01H 15/005 200/536 |
| 2007/0007119 | A1 * | 1/2007 | Rochon | 200/406 |
| 2007/0246340 | A1 * | 10/2007 | Zhao et al. | 200/339 |
| 2011/0291535 | A1 * | 12/2011 | Chen et al. | 312/309 |
| 2012/0241295 | A1 * | 9/2012 | Huang | H01H 3/50 200/330 |
| 2013/0032457 | A1 * | 2/2013 | Quinn | 200/341 |

* cited by examiner

*Primary Examiner* — Edwin A. Leon
*Assistant Examiner* — Ahmed Saeed
(74) *Attorney, Agent, or Firm* — Brownstein Hyatt Farber Schreck, LLP

(57) ABSTRACT

Slide input component assemblies of an electronic device and methods for making the same are provided. In some embodiments, a slide input component assembly may include a slide button subassembly that may have a knob, a base, a retention mechanism that may couple the knob to the base, and a shell part that may be provided about at least a portion of the base. The slide input component assembly may also include a slide switch subassembly that may have a switch that may be configured to move along a switch path when the slide button subassembly moves along a button path.

27 Claims, 13 Drawing Sheets

SLIDE INPUT COMPONENT ASSEMBLIES OF AN ELECTRONIC DEVICE AND METHODS FOR MAKING THE SAME

FIELD OF THE INVENTION

This can relate to slide input component assemblies of an electronic device and methods for making the same.

BACKGROUND OF THE DISCLOSURE

Some electronic devices include an input component assembly that may slide along an opening in a housing. Conventional sliding input component assemblies are often manufactured in such a manner that connections between distinct components of the assembly may become loose or even disengage completely after a certain amount of use.

SUMMARY OF THE DISCLOSURE

Slide input component assemblies of an electronic device and methods for making the same are provided.

In some embodiments, there may be provided an input component assembly that may include a slide button subassembly. The slide button subassembly may include a knob, a base, a retention mechanism that may couple the knob to the base, and a shell part that may be provided about at least a portion of the base. The input component assembly may also include a slide switch subassembly. The slide switch subassembly may include a switch that may be configured to move along a switch path when the slide button subassembly moves along a button path.

In other embodiments, there may be provided an electronic device that may include a recess, a housing having an opening therethrough, and an input component assembly. The input component assembly may include a slide button subassembly having a base with a tab, a knob coupled to the base, and a shell part provided about at least a portion of the base. The input component assembly may also include a slide switch subassembly that may include a switch that may be configured to move along a switch path when the knob moves along the opening, where the tab may interact with the recess to limit the movement of the knob along the opening.

In yet other embodiments, there may be provided a method of assembling an input component assembly. The method may include coupling a knob to a base using a retention mechanism. After the coupling, the method may also include molding a shell part about at least a portion of the base. After the molding, the method may also include engaging the shell part with a switch such that the shell part moves the switch along a switch path when the knob moves along a button path.

BRIEF DESCRIPTION OF THE DRAWINGS

The above and other aspects of the invention, its nature, and various features will become more apparent upon consideration of the following detailed description, taken in conjunction with the accompanying drawings, in which like reference characters may refer to like parts throughout, and in which.

DETAILED DESCRIPTION OF THE DISCLOSURE

Slide input component assemblies of an electronic device and methods for making the same are provided and described with reference to FIGS. 1-17.

Figure 1:
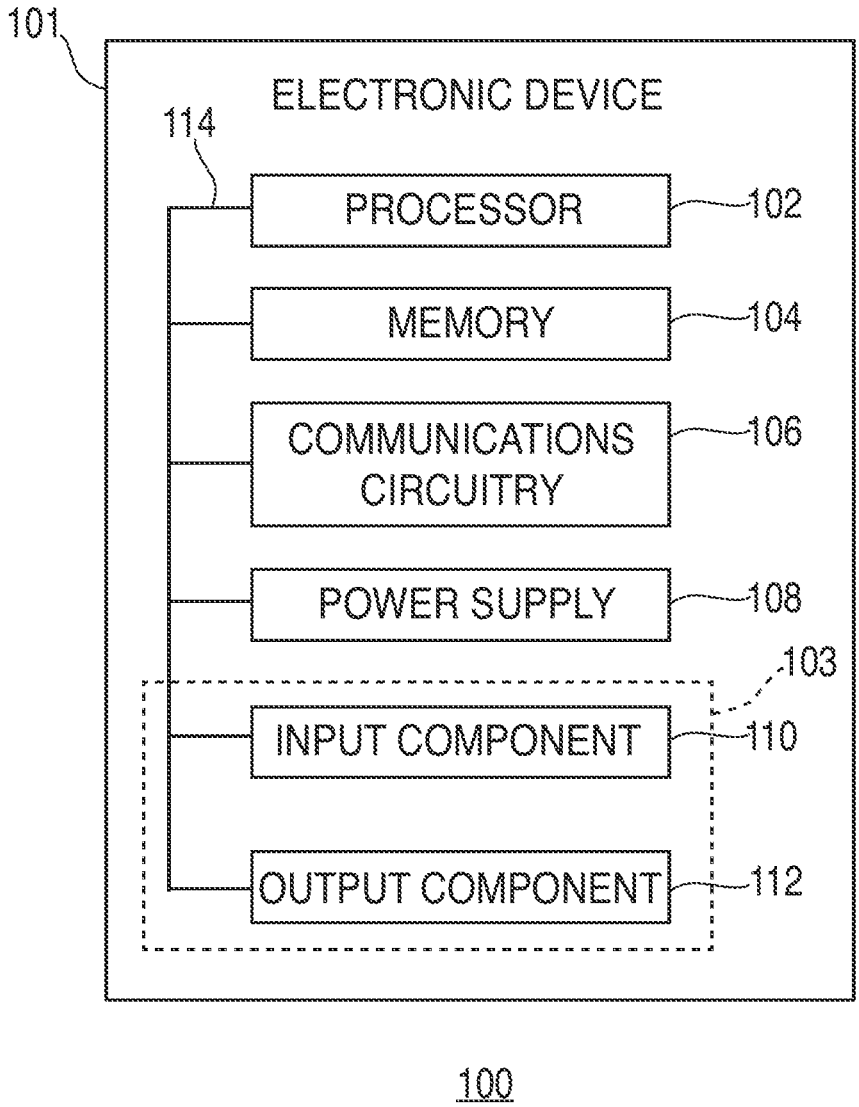
FIG. 1 is a schematic view of an illustrative electronic device, in accordance with some embodiments of the invention.

FIG. 1 is a schematic view of an illustrative electronic device 100 in accordance with some embodiments of the invention. Electronic device 100 may be any portable, mobile, or hand-held electronic device. Alternatively, electronic device 100 may not be portable, but may instead be generally stationary. Electronic device 100 can include, but is not limited to, a music player (e.g., an iPod™ available by Apple Inc. of Cupertino, Calif.), video player, still image player, game player, other media player, music recorder, movie or video camera or recorder, still camera, other media recorder, radio, medical equipment, domestic appliance, transportation vehicle instrument, musical instrument, calculator, cellular telephone (e.g., an iPhone™ available by Apple Inc.), other wireless communication device, personal digital assistant, remote control, pager, computer (e.g., a desktop, laptop, server, etc.), tablet (e.g., an iPad™ available by Apple Inc.), monitor, television, stereo equipment, set up box, set-top box, boom box, modem, router, printer, and combinations thereof. In some cases, electronic device 100 may perform a single function (e.g., an electronic device dedicated to conducting telephone calls) and in other cases, electronic device 100 may perform several functions (e.g., an electronic device that captures images, plays music, displays video, stores pictures, and conducts telephone calls). In some embodiments, electronic device 100 may be considered a miniature electronic device that may have a form factor that is smaller than that of hand-held electronic devices, such as an iPod™. Illustrative miniature electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or any combination thereof.

Electronic device 100 may include a processor or control circuitry 102, memory 104, communications circuitry 106, a power supply 108, an input component 110, and an output component 112. Electronic device 100 may also include a bus 114 that may provide one or more wired or wireless communication links or paths for transferring data and/or power to, from, or between various other components of device 100. In some embodiments, one or more components of electronic device 100 may be combined or omitted. Moreover, electronic device 100 may include other components not combined or included in FIG. 1. For example, electronic device 100 may include motion-sensing circuitry, a compass, positioning circuitry, or several instances of the components shown in FIG. 1. For the sake of simplicity, only one of each of the components is shown in FIG. 1.

Memory 104 may include one or more storage mediums, including for example, a hard-drive, flash memory, permanent memory such as read-only memory ("ROM"), semi-permanent memory such as random access memory ("RAM"), any other suitable type of storage component, or any combination thereof. Memory 104 may include cache memory, which may be one or more different types of memory used for temporarily storing data for electronic device applications. Memory 104 may store media data (e.g., music and image files), software (e.g., for implementing functions on device 100), firmware, preference information (e.g., media playback preferences), lifestyle information (e.g., food preferences), exercise information (e.g., information obtained by exercise monitoring equipment), transaction information (e.g., information such as credit card information), wireless connection information (e.g., information that may enable device 100 to establish a wireless connection), subscription information (e.g., information that keeps track of podcasts or television shows or other media a user subscribes to), contact information (e.g., telephone numbers and e-mail addresses), calendar information, any other suitable data, or any combination thereof.

Communications circuitry 106 may be provided to allow device 100 to communicate with one or more other electronic devices using any suitable communications protocol. For example, communications circuitry 106 may support Wi-Fi (e.g., an 802.11 protocol), Ethernet, Bluetooth™, high frequency systems (e.g., 900 MHz, 2.4 GHz, and 5.6 GHz communication systems), infrared, transmission control protocol/internet protocol ("TCP/IP") (e.g., any of the protocols used in each of the TCP/IP layers), hypertext transfer protocol ("HTTP"), BitTorrent™, file transfer protocol ("FTP"), real-time transport protocol ("RTP"), real-time streaming protocol ("RTSP"), secure shell protocol ("SSH"), any other communications protocol, or any combination thereof. Communications circuitry 106 may also include circuitry that can enable device 100 to be electrically coupled to another device (e.g., a host computer or an accessory device) and communicate with that other device, either wirelessly or via a wired connection.

Power supply 108 may provide power to one or more of the components of device 100. In some embodiments, power supply 108 can be coupled to a power grid (e.g., when device 100 is not a portable device, such as a desktop computer). In some embodiments, power supply 108 can include one or more batteries for providing power (e.g., when device 100 is a portable device, such as a cellular telephone). As another example, power supply 108 can be configured to generate power from a natural source (e.g., solar power using solar cells).

One or more input components 110 may be provided to permit a user to interact or interface with device 100. For example, input component 110 can take a variety of forms, including, but not limited to, a touch pad, dial, switch, click wheel, scroll wheel, touch screen, one or more buttons (e.g., a keyboard), mouse, joy stick, track ball, microphone, camera, proximity sensor, light detector, motion sensor, and combinations thereof. Each input component 110 can be configured to provide one or more dedicated control functions for making selections or issuing commands associated with operating device 100.

Electronic device 100 may also include one or more output components 112 that may present information (e.g., graphical, audible, and/or tactile information) to a user of device 100. Output component 112 of electronic device 100 may take various forms, including, but not limited to, an audio speaker, headphone, audio line-out, video line-out, visual display, antenna, infrared port, rumbler, vibrator, and combinations thereof. Each output component 112 can be configured to provide information from one or more other components of device 100 (e.g., processor 102) to a user of device 100.

It should be noted that one or more input components 110 and one or more output components 112 may sometimes be referred to collectively herein as an input/output ("I/O") component or I/O interface. For example, input component 110 and output component 112 may sometimes be a single I/O component 103, such as a touch screen, that may receive input information through a user's touch of a display screen and that may also provide visual information to a user via that same display screen.

Processor 102 of device 100 may include any processing circuitry operative to control the operations and performance of one or more components of electronic device 100. For example, processor 102 may be used to run operating system applications, firmware applications, graphics editing applications, media playback applications, media editing applications, or any other application. In some embodiments, processor 102 may receive input signals from input component 110 and/or drive output signals through output component 112. Processor 102 may load a user interface program (e.g., a program stored in memory 104 or in another device or server accessible by device 100) to determine how instructions or data received via an input component 110 may manipulate the way in which information is stored and/or provided to the user via an output component 112.

Electronic device 100 may also be provided with a housing 101 that may at least partially enclose one or more of the components of device 100 for protection from debris and other degrading forces external to device 100. In some embodiments, one or more of the components may be provided within its own housing (e.g., input component 110 may be an independent keyboard or mouse within its own housing that may wirelessly or through a wire communicate with processor 102, which may be provided within its own housing).

Figure 2:
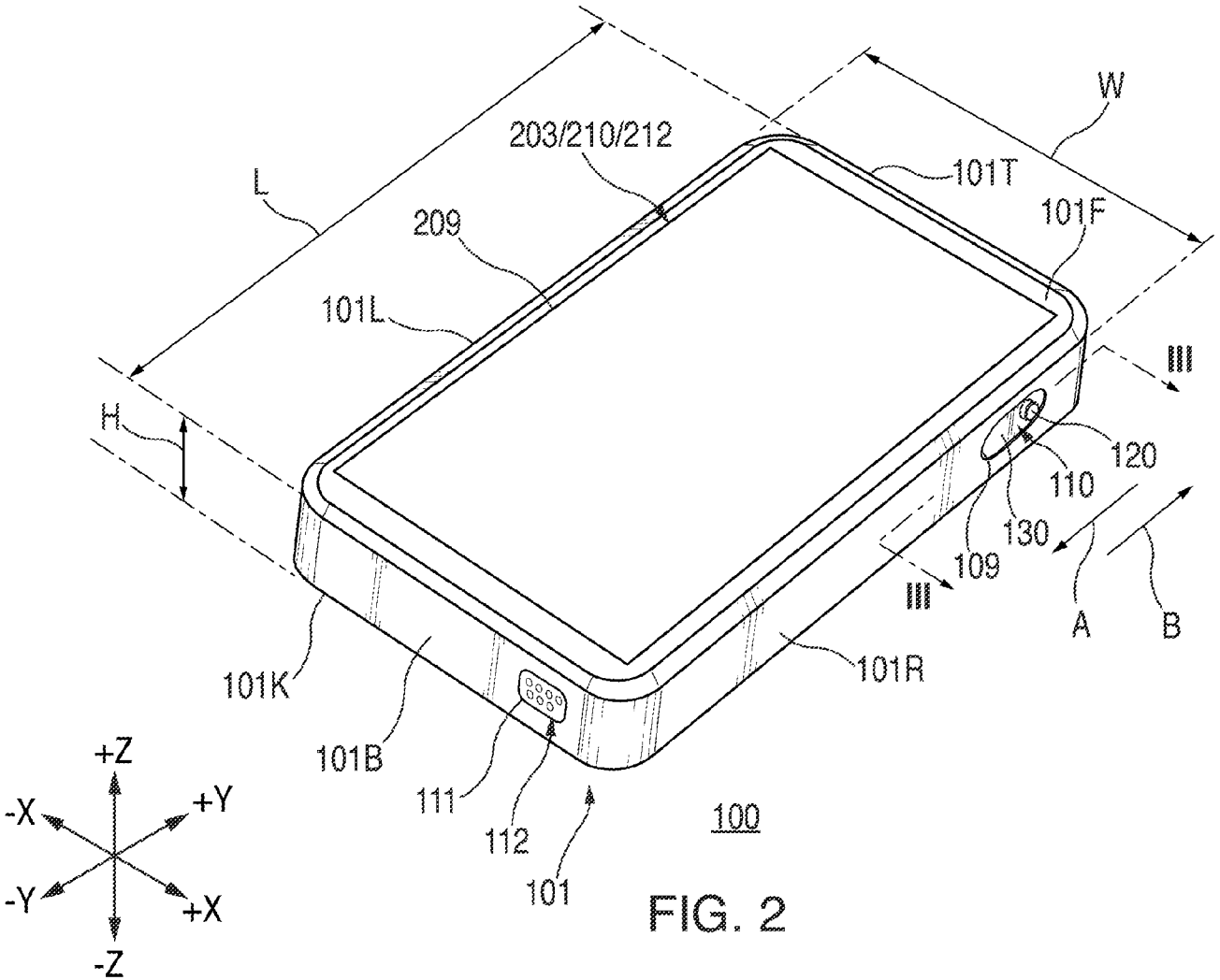
FIG. 2 is a perspective view of the electronic device of FIG. 1, in accordance with some embodiments of the invention.

FIG. 2 is a perspective view of a fully assembled electronic device 100 in accordance with some embodiments of the invention. As shown, electronic device 100 can include at least a first input component 110 and a first output component 112. Moreover, as shown, electronic device 100 may also include a second input component 210 and a second output component 212. In some embodiments, second input component 210 and second output component 212 may be an I/O component 203. As shown in FIG. 2, housing 101 may at least partially enclose input component 110, output component 112, and I/O component 203 of device 100. Housing 101 may be any suitable shape and may include any suitable number of walls. In some embodiments, as shown in FIG. 2, for example, housing 101 may be of a generally hexahedral shape and may include a bottom wall 101B, a top wall 101T that may be opposite bottom wall 101B, a left wall 101L, a right wall 101R that may be opposite left wall 101L, a front wall 101F, and a back wall 101K that may be opposite front wall 101F. As shown in FIG. 2, for example, the size of device 100 may be defined along the X-axis by an overall housing width W of housing 101 that may extend between left surface 101L and right surface 101R, along the Y-axis by an overall housing length L of housing 101 that may extend between top surface 101T and bottom surface 101B, and along the Z-axis by an overall housing height H of housing 101 that may extend between front surface 101F and back surface 101K. Although, in other embodiments, it is to be understood that housing 101 may be any other suitable shape and may include any other suitable number of walls of any other suitable geometries.

As shown in FIG. 2, for example, first input component 110 may be a slide input component assembly, and first output component 112 may be an audio output assembly (e.g., a speaker for outputting sound waves). Although, it is to be understood that in other embodiments, first input component 110 may be any other suitable type of input component and first output component 112 may be any other suitable type of output component. As shown, first input component 110 may be positioned at least partially under or through an opening 109, which may be provided through right surface 101R of housing 101, while first output component 112 may be positioned at least partially under or through an opening 111, which may be provided through bottom surface 101B of housing 101. Although, in other embodiments, it is to be understood that each one of first input component 110 and first output component 112 may be provided through any other surface or surfaces of housing 101.

As also shown in FIG. 2, for example, second input component 210 and second output component 212 of I/O component 203 may be a touch screen (e.g., a multi-touch screen), that may receive input information through a user's touch of a display screen and that may also provide visual information to a user via that same display screen. For example, second input component 210 of I/O component 203 may be a touch assembly and second output component 212 of I/O component 203 may be a display assembly, where the display assembly and touch assembly may be integrated with one another and or provided in a stacked configuration (e.g., along the Z-axis). Although, it is to be understood that in other embodiments, second input component 210 may be any other suitable type of input component and second output component 212 may be any other suitable type of output component. As shown, I/O component 203 may be positioned at least partially under or through an opening 209, which may be provided through front surface 101F of housing 101. Although, in other embodiments, it is to be understood that each one of second input component 210 and second output component 212 of I/O component 203 may be provided through any other surface or surfaces of housing 101.

Figure 5:
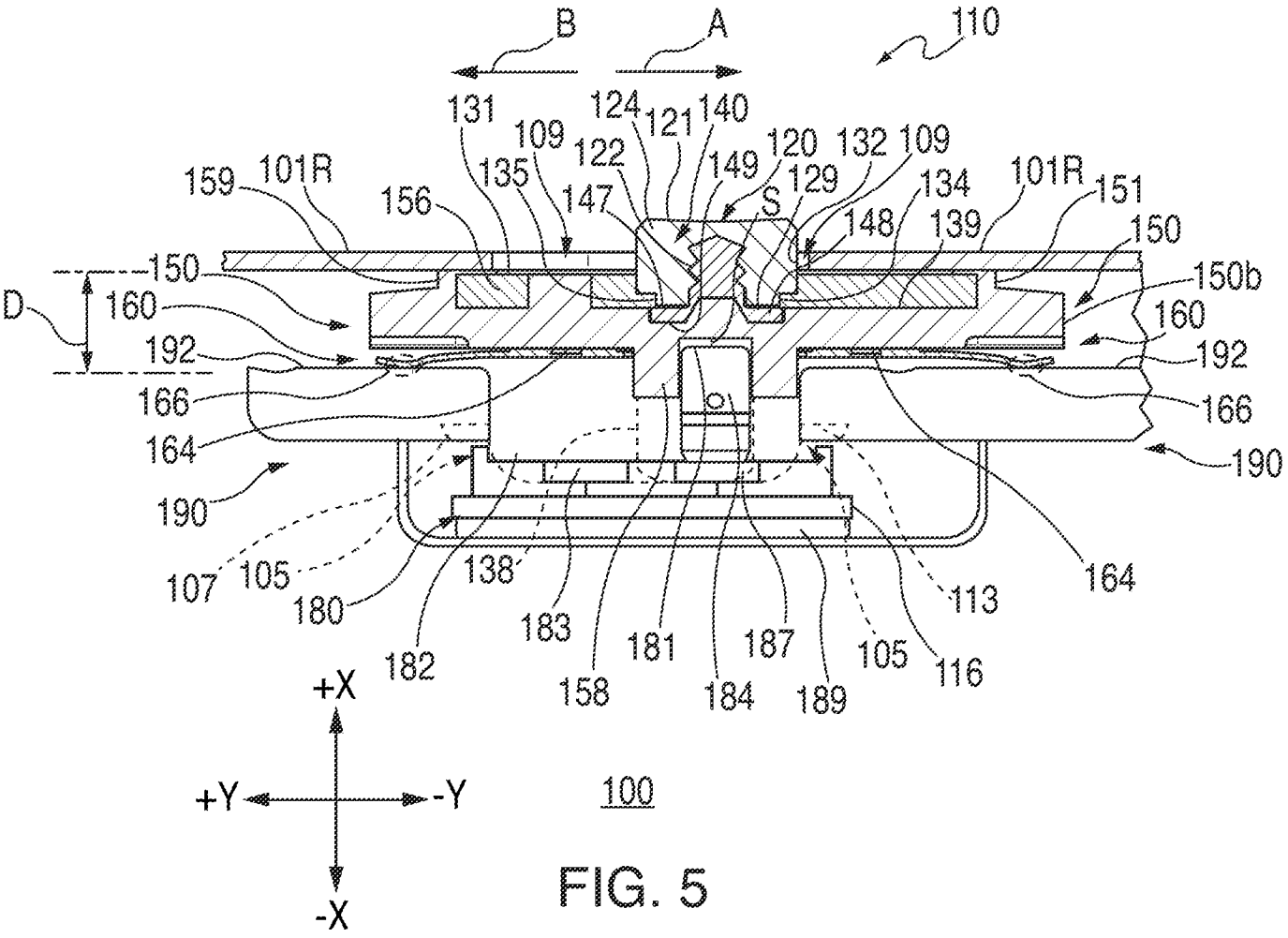
FIG. 5 is a cross-sectional view of the slide input component assembly of FIGS. 1-4, similar to FIG. 3, but with the slide input component assembly in a second stage of actuation, in accordance with some embodiments of the invention.
Figure 6:
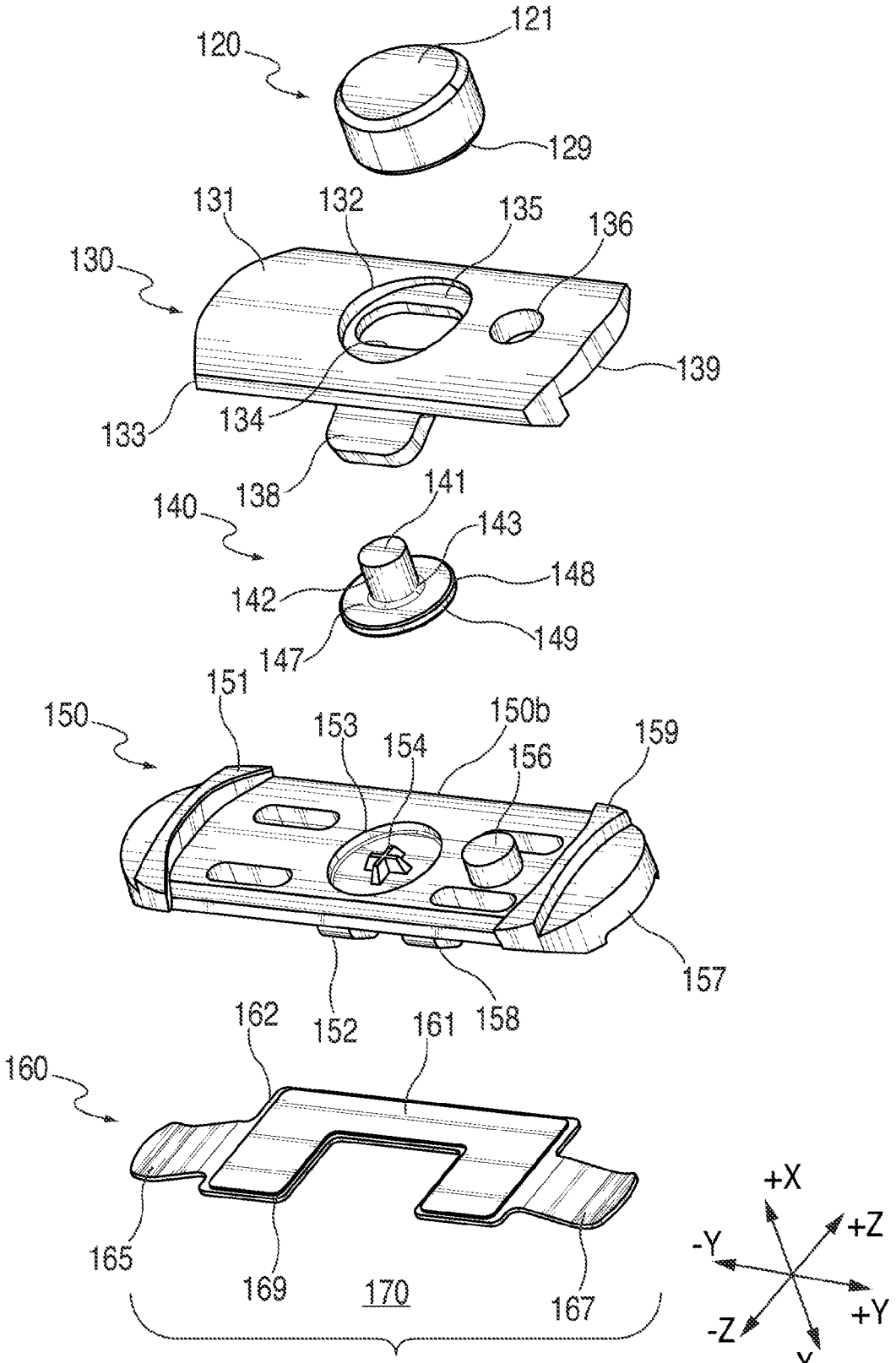
FIG. 6 is a first perspective exploded view of a slide button subassembly of the slide input component assembly of FIGS. 1-5, in accordance with some embodiments of the invention.

As shown in FIGS. 2-15, for example, slide input component assembly 110 may include a slide button subassembly 170 that may be at least partially exposed through opening 109 and that may be slid along opening 109 by a user of device 100 (e.g., in the direction of arrow A and/or the direction of arrow B). Slide input component assembly 110 may also include a slide switch subassembly 180 that may be moved from a first functional state to a second functional state when slide button subassembly 170 is slid along opening 109. As shown in FIGS. 3-5, 14, and 15, for example, slide switch subassembly 180 may include a switch path or track 182 and a switch 184 that may be configured to slide within and/or along track 182 between a first functional position (e.g., as shown in FIGS. 3, 4, 14, and 15) at a first point along the length of track 182 and at least a second functional position (e.g., as shown in FIG. 5) at a second point along the length of track 182. As a user of device 100 moves slide button subassembly 170 along opening 109 (e.g., moves a knob 120 either in the direction of arrow A or arrow B along opening 109 (e.g., along a button path or knob path defined by opening 109 along the Y-axis)), slide button subassembly 170 may correspondingly move switch 184 between its first and second functional positions along track 182, which may change a functional state of device 100 (e.g., to lock the orientation of content displayed by I/O component 203 with respect to housing 101).

As shown in FIGS. 3-5 and 15, for example, slide switch subassembly 180 can also include one or more contact points (e.g., contact points 183 and 187) that may be provided at least partially through track 182 under at least one of the functional positions of switch 184. Each of the one or more contact points 183 and 187 of slide input component assembly 110 can be coupled to a processor (e.g., processor 102) of device 100, for example, via a connector 116. Connector 116 may be a flexible connector (e.g., a "flex cable") or any other suitable path for communicating power and/or electrical information between processor 102 and slide input component assembly 110 (e.g., a connector of bus 114). For example, when switch 184 is at a functional position along track 182, switch 184 may create an electrical connection or circuit with one of the one or more contact points 183 and 187, which may change the function or logic of processor 102 of device 100. Slide switch subassembly 180 can be any type of switch assembly with a track (e.g., track 182) and at least one contact point (e.g., contact point 183 and/or contact point 187), including, but not limited to, a single pole single throw ("SPST") switch, a single pole double throw ("SPDT") switch, a single pole center off ("SPCO") switch, a double pole single throw ("DPST") switch, a double pole double throw ("DPDT") switch, a double pole center off ("DPCO") switch, a maintained contact switch, a momentary contact switch, a fader or limitless contact switch, or combinations thereof.

Slide switch subassembly 180 of slide input component assembly 110 may be held in place within housing 101 (e.g., with respect to opening 109) in various ways such that switch 184 may be accessible to a user external to housing 101 via slide button subassembly 170. For example, as shown in FIGS. 3-5 and 15, track 182 (e.g., contact points 183 and 187) may be soldered or otherwise coupled to connector 116, connector 116 may be adhered (e.g., by a pressure sensitive adhesive ("PSA")) or otherwise coupled to a stiffener 190, and stiffener 190 may be fixed (e.g., via one or more screws through housing hole 115 and stiffener hole 195) or otherwise coupled to housing 101. In other embodiments, slide switch subassembly 180 may be directly coupled to a portion of housing 101 or to any other component or components of device 100 such that track 182 may be retained in a certain position with respect to opening 109 for interacting with slide button subassembly 170. In some embodiments, stiffener 190 may be integrated with the structure of slide switch subassembly 180.

As shown in FIGS. 3-15, for example, slide button subassembly 170 of slide input component assembly 110 may include a knob 120 that may be coupled to a base 130 by a retention mechanism 140, at least one shell or molded part 150 that may be molded or otherwise formed or provided about at least a portion of base 130, and a biasing mechanism 160 that may be coupled to part 150. At least a portion of slide button subassembly 170 may be the portion of slide input component assembly 110 that a user may see (e.g., via opening 109) and interact with. Therefore, various features of slide button subassembly 170 may be configured to match or aesthetically accentuate housing 101.

Knob 120 may include a main body portion 124 and an alignment body portion 126. Main body portion 124 may extend between a top surface 121 and a mid-surface 127 of knob 120, and alignment body portion 126 may extend between mid-surface 127 and a bottom surface 129 of knob 120. At least a portion of knob 120 may be configured to extend through opening 109 of housing 101 such that a user may interact with knob 120 (e.g., with top surface 121 of knob 120) for sliding slide button subassembly 170 along opening 109. Therefore, in some embodiments, knob 120 may be provided by one or more materials that may match the material forming housing 101, such as anodized aluminum. Furthermore, knob 120 may include a retention feature 122 that may interact with retention mechanism 140 for coupling knob 120 to base 130. For example, in some embodiments, as shown, retention feature 122 may include an opening or passageway extending from bottom surface 129 and through at least a portion of knob 120 (e.g., through at least a portion of alignment body portion 126 and, in some embodiments, through a portion of main body portion 124). Such a passageway may be provided with internal threading for mating with and retaining complimentary threading of retention mechanism 140 (e.g., if retention mechanism is a screw).

Base 130 may include a main body portion 133 and a tab 138 that may extend away from main body portion 133. Main body portion 133 may extend between a top surface 131 and a bottom surface 139 of base 130. Base 130 may also include at least one feature for securing knob 120 to base 130 with retention mechanism 140 and/or aligning knob 120 with base 130. For example, as shown, base 130 may include a first opening 132 that may extend through main body portion 133 from top surface 131 to a mid-surface 135 of main body portion 133, and a second opening 134 that may extend through main body portion 133 from mid-surface 135 to bottom surface 139 of main body portion 133. Moreover, as shown, first opening 132 and second opening 134 may at least partially overlap at mid-surface 135. In some embodiments, first opening 132 may be configured to receive and/or surround at least a portion of knob main body portion 124, while second opening 134 may be configured to receive and/or surround at least a portion of knob alignment body portion 126. While knob main body portion 124 and/or first opening 132 may have a circular cross-section, knob alignment body portion 126 and second opening 134 may have a non-circular (e.g., oval) cross-section, such that knob alignment body portion 126 may be prevented from rotating within second opening 134 (e.g., about the X-axis). By preventing rotation of knob alignment body portion 126 within second opening 134, knob 120 may be properly oriented with respect to base 130 when knob alignment body portion 126 is positioned within second opening 134 of base 130. Proper orientation of knob 120 with respect to base 130 (e.g., about the X-axis) may ensure that certain features of knob 120 are properly oriented with respect to housing 101 when base 130 is properly oriented with respect to housing 101. For example, when slide input component assembly 110 is fully assembled within housing 101, an arched or bowed or concave portion of top surface 121 of knob 120 may be oriented in an X-Y plane (see, e.g., FIG. 3), while a flat portion of top surface 121 of knob 120 may be oriented in an X-Z plane (see, e.g., FIG. 4). Base 130 may be any suitable material, such as metal. In some embodiments, base 130 may be provided by one or more materials that may match the material forming housing 101, such as anodized aluminum.

Figure 7:
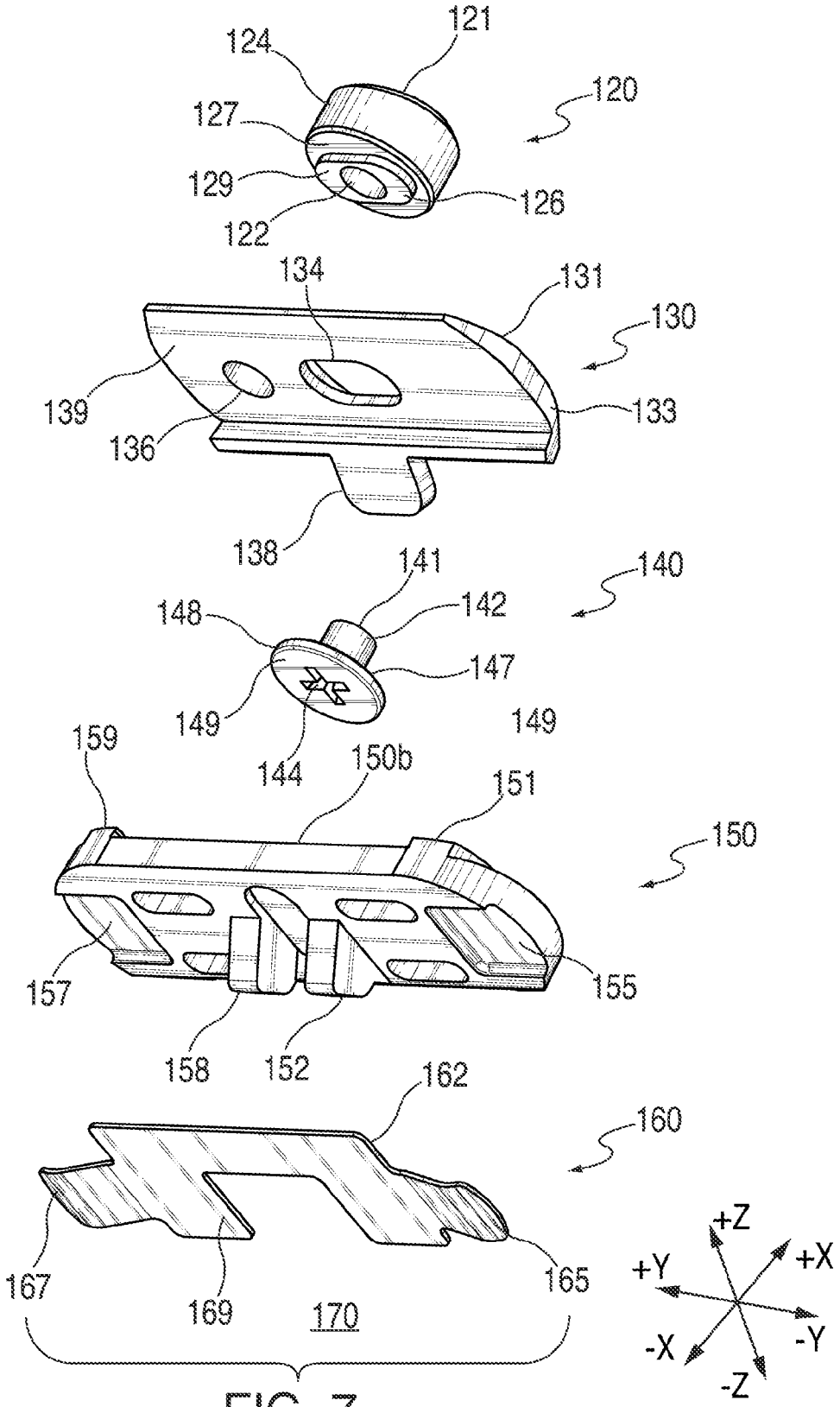
FIG. 7 is a second perspective exploded view of the slide button subassembly of the slide input component assembly of FIGS. 1-6, in accordance with some embodiments of the invention.
Figure 8:
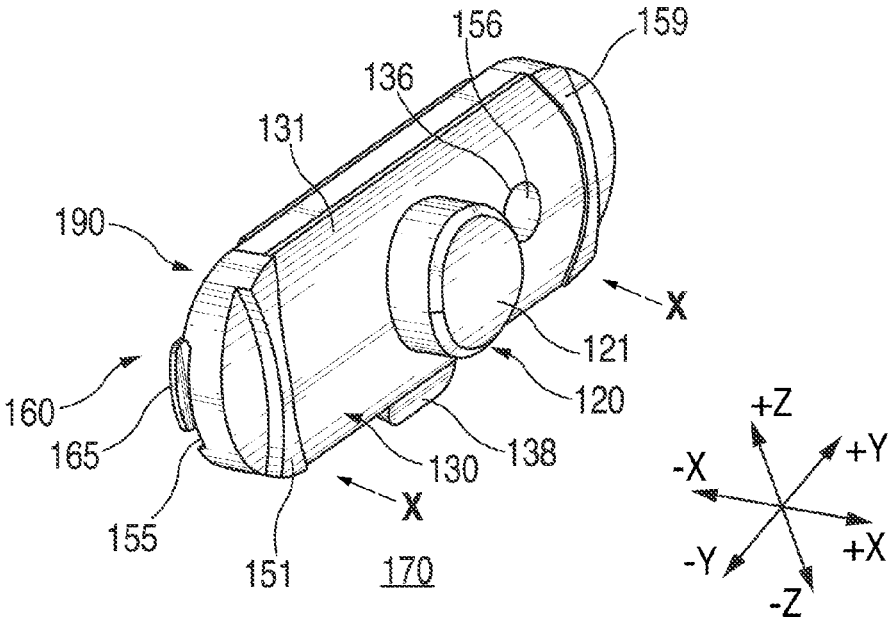
FIG. 8 is a third perspective view of the slide button subassembly of the slide input component assembly of FIGS. 1-7, in accordance with some embodiments of the invention.
Figure 9:
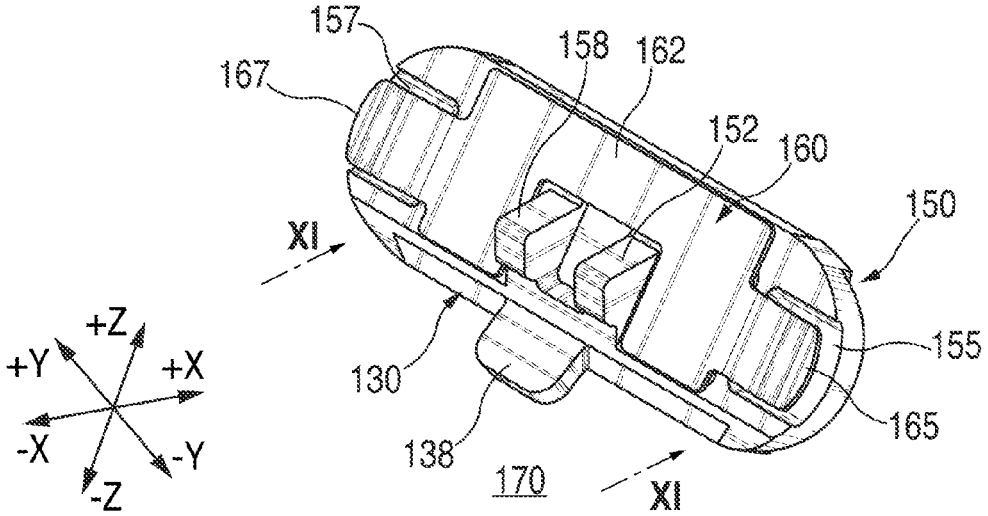
FIG. 9 is a fourth perspective view of the slide button subassembly of the slide input component assembly of FIGS. 1-8, in accordance with some embodiments of the invention.
Figure 10:
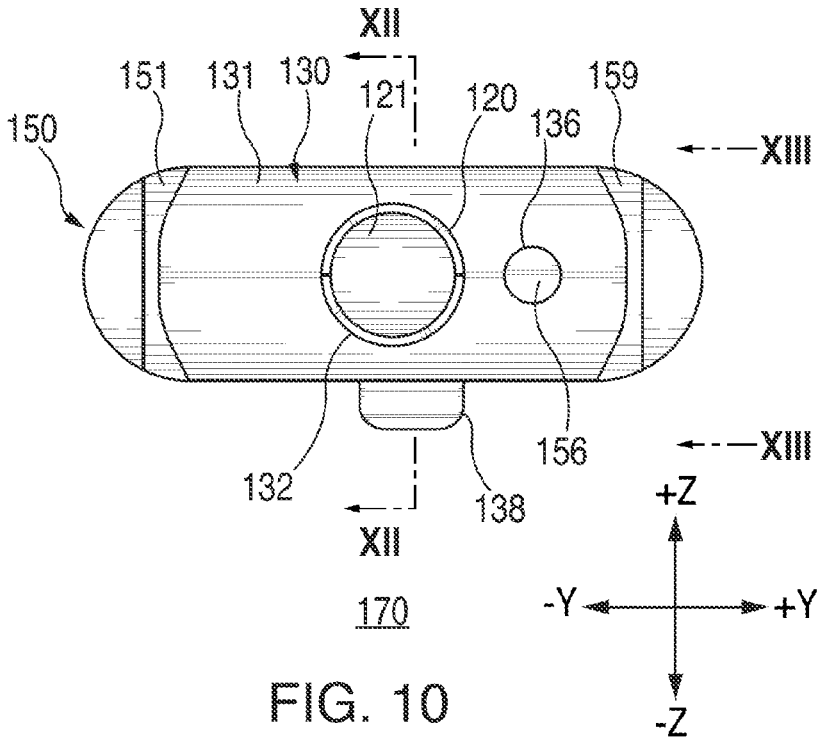
FIG. 10 is a first side elevational view of the slide button subassembly of the slide input component assembly of FIGS. 1-9, taken from line X-X of FIG. 8, in accordance with some embodiments of the invention.
Figure 11:
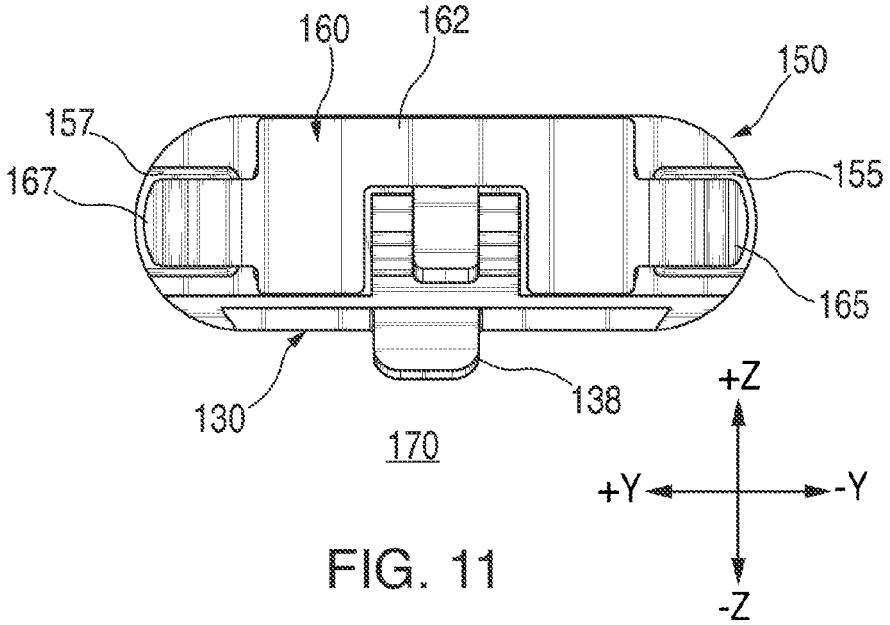
FIG. 11 is a second side elevational view of the slide button subassembly of the slide input component assembly of FIGS. 1-10, taken from line XI-XI of FIG. 9, in accordance with some embodiments of the invention.
Figure 12:
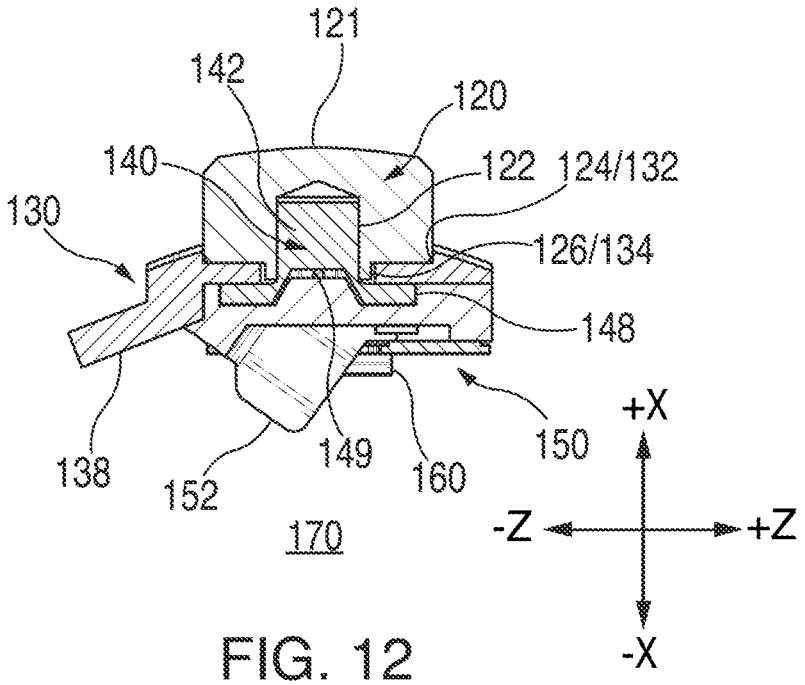
FIG. 12 is a cross-sectional view of the slide button subassembly of the slide input component assembly of FIGS. 1-11, taken from line XII-XII of FIG. 10, in accordance with some embodiments of the invention.
Figure 13:
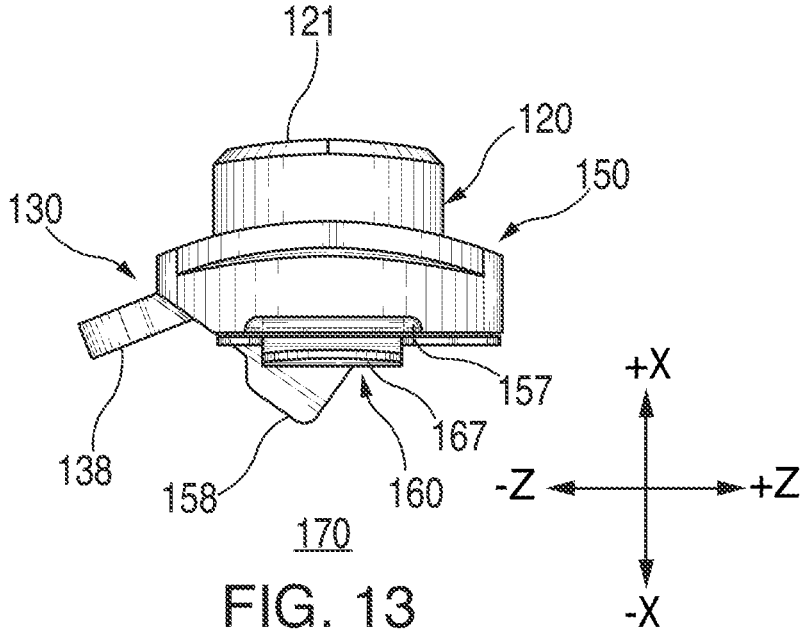
FIG. 13 is a third side elevational view of the slide button subassembly of the slide input component assembly of FIGS. 1-12, taken from line XIII-XIII of FIG. 10, in accordance with some embodiments of the invention.
Figure 14:
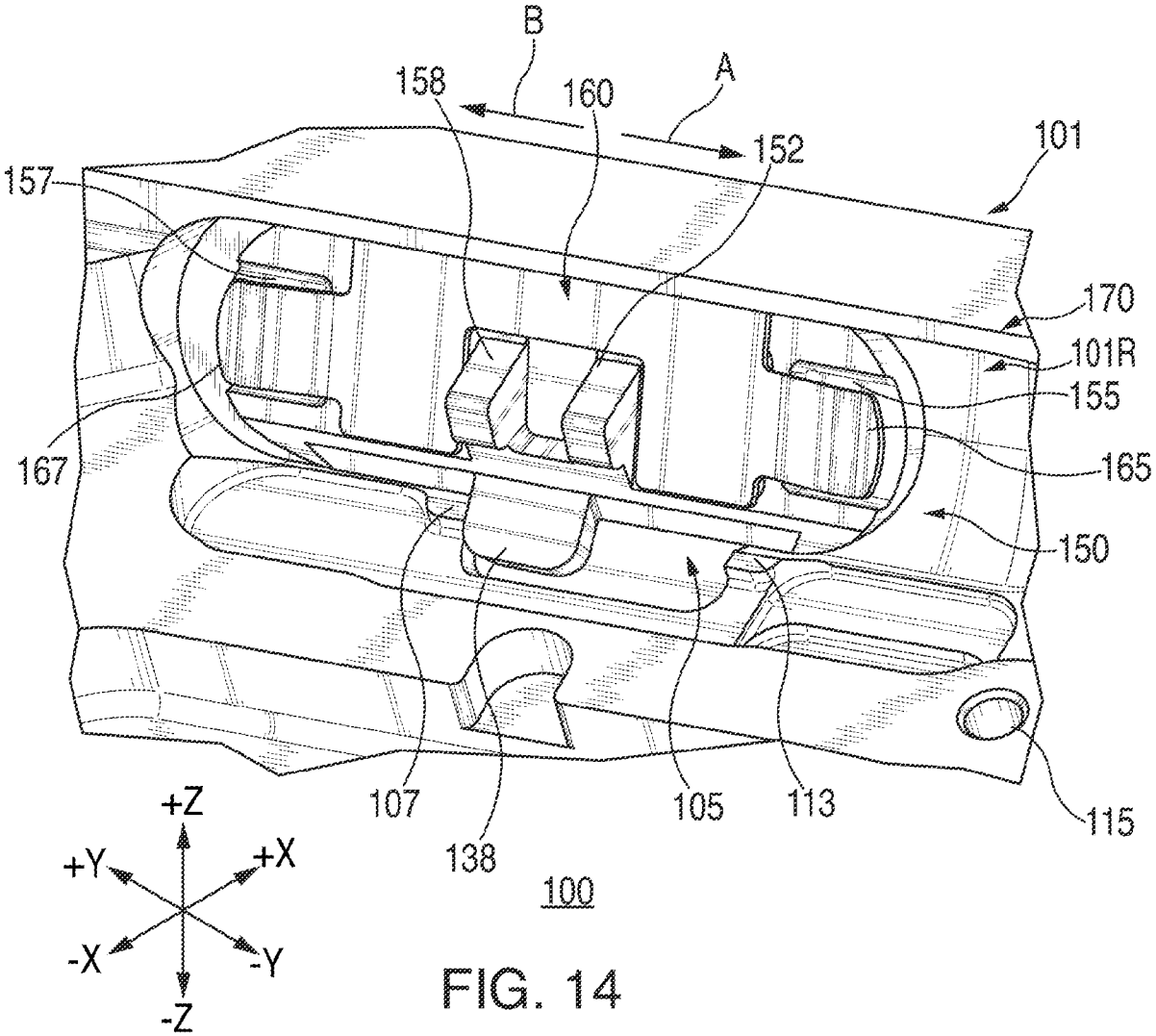
FIG. 14 is a perspective view of the slide button subassembly of the slide input component assembly of FIGS. 1-13, similar to FIG. 9, but positioned within the electronic device of FIGS. 1-5, in accordance with some embodiments of the invention.

Retention mechanism 140 may include a main body portion 142 and a head body portion 148. Main body portion 142 may extend from a free end 141 to a second end 143 that may be coupled to a top surface 147 of head body portion 148, and head body portion 148 may extend from top surface 147 to a bottom surface 149. For example, as shown, retention mechanism 140 may be a screw, whereby main body portion 142 may include threading along its exterior surface (e.g., for mating with and retaining complimentary threading of knob retention feature 122), and whereby head body portion 148 may include a drive design 144 in bottom surface 149 that may be engaged by a tool (e.g., a screwdriver (not shown)) for driving at least a portion of main body portion 142 to interact with and engage knob retention feature 122. As shown in FIG. 7, for example, drive design 144 may be a Phillips drive design, although any other suitable geometrical design may be used that can engage with a tool for driving retention mechanism 140. When knob

120 is positioned adjacent to top surface 131 of base 130 and/or within base 130 (e.g., within first opening 132 and/or second opening 134 from top surface 131), retention mechanism 140 may be configured to engage with knob retention feature 122 through bottom surface 139 of base 130 (e.g., through first opening 132 and/or second opening 134 from bottom surface 139). For example, as shown, when assembled, main body portion 142 may pass through at least a portion of base opening 132 and/or base opening 134 and into knob retention feature 122 for mating with and retaining complimentary threading of knob retention feature 122), and thereby retaining at least a portion of base 130 between knob 120 and retention mechanism 140. For example, as shown in FIG. 5, mid-surface 135 of main body portion 133 may be retained between main body portion 124 of knob 120 and head body portion 148 of retention mechanism 140. It is to be understood that, although retention mechanism 140 and knob 120 may be shown and described as configured to couple base 130 to knob 120 via a screw and thread engagement technique, knob 120 and retention mechanism 140 may be configured to couple base 130 to knob 120 in various other suitable ways. For example, in other embodiments, knob 120 may include a screw and retention mechanism 140 may include internal threading. In yet other embodiments, retention mechanism 140 may be solder, glue, laser welding, or any other suitable mechanism for coupling base 130 to knob 120. By coupling a distinct knob 120 to base 130 may allow for knob 120 and base 130 to be formed via different processes. For example, base 130 may be stamped, while knob 120 and/or retention mechanism 140 may be machined. In some embodiments, base body 133 and/or tab 138 may be stamped and base openings (e.g., openings 132, 134, and/or 136) may be machined (e.g., via computer numerical control ("CNC")).

Shell or molded part 150 may be molded or otherwise formed or provided about at least a portion of base 130. For example, in some embodiments, part 150 may be molded about at least a portion of base 130 once base 130 has been coupled to knob 120 by retention mechanism 140. Alternatively, at least a portion of part 150 may be molded about at least a portion of base 130 before knob 120 is coupled to base 130. Part 150 may be formed by insert and/or injection molding plastic or any other suitable material about at least a portion of base 130. As shown, part 150 may include a body 150*b*, a first overhang 151 extending from body 150*b* and over base 130 that may retain a first portion of base 130 between a first end of body 150*b* and first overhang 151 (e.g., for retaining base 130 along the X-axis), and a second overhang 159 extending from body 150*b* and over base 130 that may retain a second portion of base 130 between a second end of body 150*b* and second overhang 159 (e.g., for retaining base 130 along the X-axis). A portion of base 130 may be retained between first overhang 151 and second overhang 159 (e.g., for retaining base 130 along the Y-axis and/or along the Z-axis). In some embodiments, as shown, each one of overhangs 151 and 159 may also be proximate housing 101 about opening 109. For example, overhangs 151 and 159 of molded part 150 may be an interface between slide button subassembly 170 and housing 101 when assembly 110 is fully assembled. Therefore, molded overhangs 151 and 159 may prevent top surface 131 of base 130 from contacting housing 101 about opening 109. This may prevent galling between base 130 and housing 101, each of which may be metal.

Moreover, in some embodiments, as shown, part 150 may include an indicator portion 156 that may extend from a top surface of body 150*b* and through an indicator opening 136, which may be provided through main body portion 133 of base 130 between top surface 131 and bottom surface 139. Indicator portion 156 of part 150 may be exposed through opening 109 to a user when slide button subassembly 170 (e.g., knob 120) is moved along opening 109 in the direction of arrow A from a first functional position of FIG. 3 to a second functional position of FIG. 5. When indicator portion 156 is visible to a user through opening 109, the user may understand that slide button subassembly 170 is in its second functional position. On the other hand, when indicator portion 156 is not exposed to a user through opening 109, the user may understand that slide button subassembly 170 is in its first functional position of FIG. 3 (e.g., when indicator portion 156 is hidden underneath right wall 101R of housing 101). The material (e.g., plastic) used to form part 150 or at least indicator portion 156 of part 150 may be of a particular color that may be easily noticeable by a user (e.g., orange).

Moreover, in some embodiments, part 150 may include an indent 153 within body 150*b* that may receive and/or be molded at least partially about head body portion 148 of retention mechanism 140. Additionally or alternatively, part 150 may include one or more features 154 that may be provided and/or molded within each drive design feature 144 of retention mechanism 140. Such formation (e.g., molding or otherwise) of part features 154 within retention features 144 of retention mechanism 140 may prevent any rotation of retention mechanism 140 that may allow retention mechanism 140 to disengage from retention features 122 of knob 120 (e.g., any rotation within the Y-Z plane that may allow a screw 140 to rotate out from within a threaded hollow of knob 120).

Figure 15:
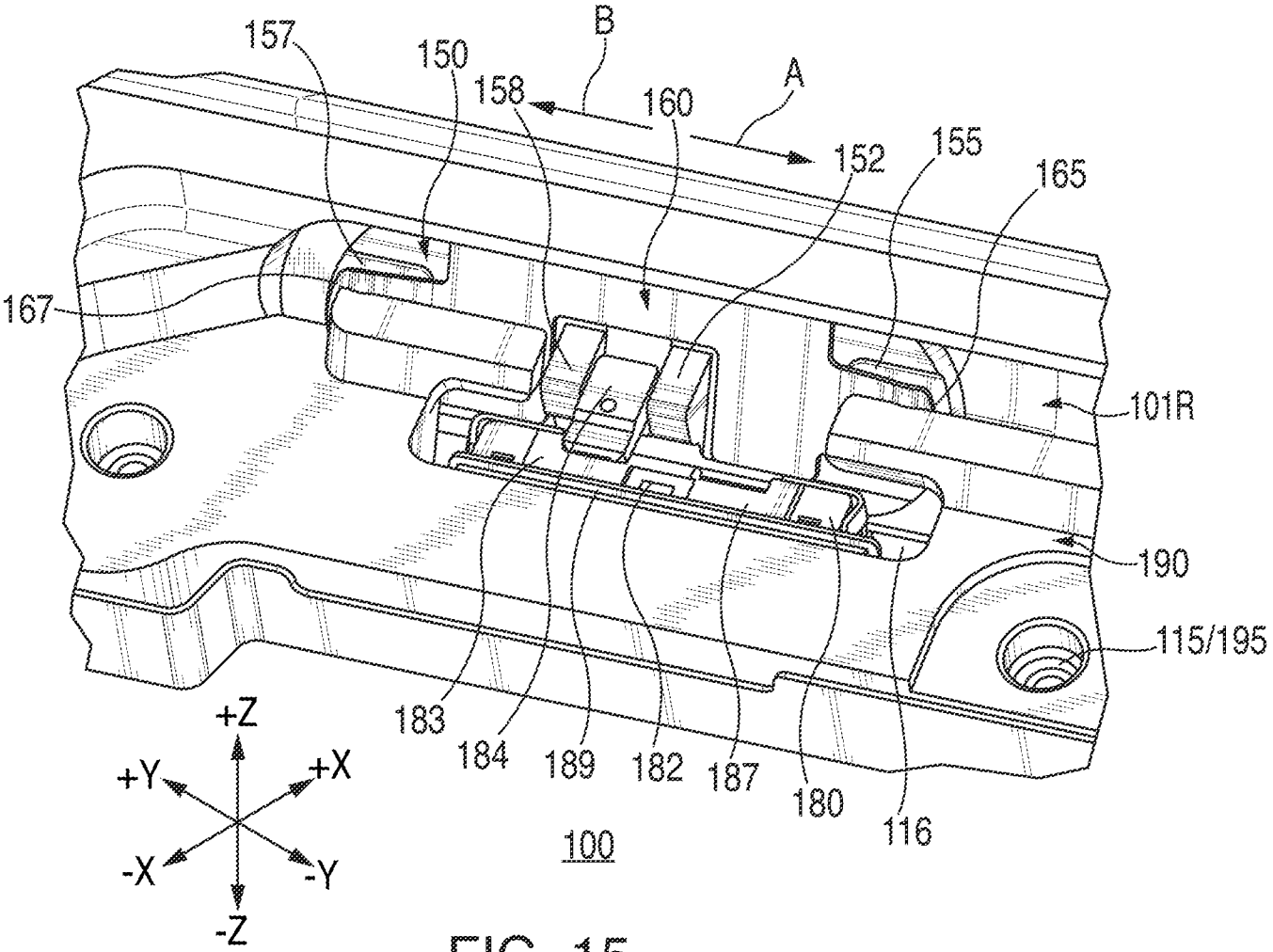
FIG. 15 is a perspective view of the slide button subassembly of the slide input component assembly of FIGS. 1-14, similar to FIG. 14, but now with a slide switch subassembly of the slide input component assembly, in accordance with some embodiments of the invention.
Figure 16:
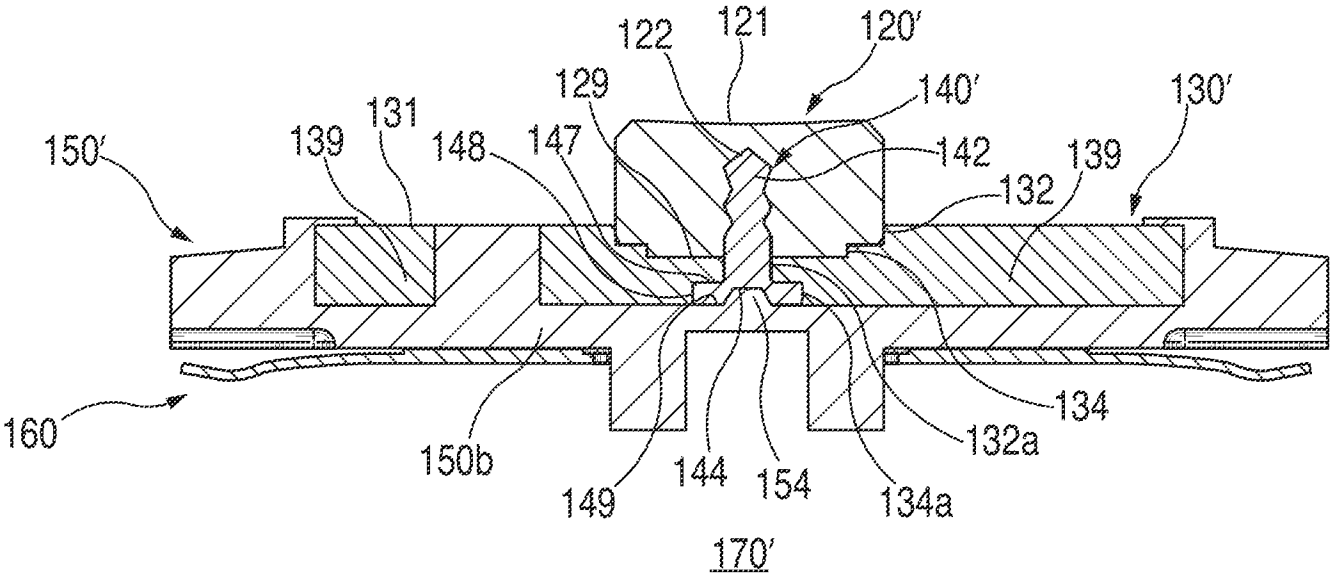
FIG. 16 is a cross-sectional view, similar to FIG. 4, of a portion of an alternative slide button subassembly, in accordance with some embodiments of the invention.

In some embodiments, as shown in FIGS. 3-15, for example, when knob 120 is coupled to base 130 via retention mechanism 140 of slide button subassembly 170, top surface 147 of head body portion 148 of retention mechanism 140 may be held against bottom surface 129 of knob 120 and/or against bottom surface 139 of base 130. This may allow for indent 153 within body 150*b* of part 150 to at least partially receive head body portion 148. However, in other embodiments, as shown in FIG. 16, for example, when a knob 120' is coupled to a base 130' via a retention mechanism 140' of an alternative slide button subassembly 170', a portion of main body portion 142 of retention mechanism 140' may be held within another opening 132*a* in base 130' and head body portion 148' of retention mechanism 140' may be held within another opening 134*a* in base 130', such that bottom surface 149 of retention mechanism 140' may be held against the top surface of body 150*b* of part 150, and such that no indent of part 150 (e.g., no indent 153 within body 150*b*) at least partially receives head body portion 148 of retention mechanism 140'.

Moreover, in some embodiments, as shown in FIGS. 3-15, for example, part 150 may include one or more switch grips that may extend away from a bottom surface of body 150*b* and about at least a portion of switch 184 of slide switch subassembly 180. For example, as shown, part 150 may include a first switch grip 152 and a second switch grip 158 that may engage switch 184. The relationship between the geometry of switch 184 and the geometry of grips 152 and 158 thereabout may allow for slide button subassembly 170 to maintain contact with at least a portion of switch 184 at all times when knob 120 may slide along opening 109 between its first functional position of FIG. 3 and its second functional position of FIG. 5, and, thus, grips 152 and 158 may correspondingly slide switch 184 along track 182 between its first functional position of FIG. 3 (e.g., at contact 183) and its second functional position of FIG. 5 (e.g., at contact 187).

Biasing mechanism 160 may include a body 162 that may extend between a top surface 161 and a bottom surface 169. Moreover, biasing mechanism 160 may include one or more biasing features (e.g., biasing features 165 and 167) that may extend from body 162. Biasing mechanism 160 may be positioned between part 150 and stiffener 190 and/or slide switch subassembly 180 in order to account for any tolerances of a distance D (see, e.g., FIG. 5) between stiffener 190 and housing 101 within which part 150 and biasing mechanism 160 may reside (e.g., along the X-axis). For example, as shown, biasing mechanism 160 may be positioned between part 150 and a top surface 192 of stiffener 190, such that biasing mechanism 160 may bias part 150 upwards in the +X-direction away from top surface 192 of stiffener 190 towards housing 101 about opening 109 (e.g., towards the internal surfaces of right wall 101R about opening 109, such that overhangs 151 and 159 may contact housing 101 about opening 109). In some embodiments, as shown, top surface 161 of biasing mechanism 160 may be coupled to part 150 (e.g., via PSA or any other suitable coupling feature 164), such that each one of biasing features 165 and 167 may extend downwardly (e.g., in the −X-direction) and contact top surface 192 of stiffener 190 (e.g., on opposite sides of switch 184).

Each one of biasing features 165 and 167 may be any suitable biasing feature for providing a biased downward force onto stiffener 190 and/or slide switch subassembly 180 for biasing molded part 150 upwards away from stiffener 190 and/or slide switch subassembly 180 and towards opening 109. For example, each one of biasing features 165 and 167 may be a spring mechanism (e.g., a metal spring) with a free end portion. Each free end portion may be deflected back upwards towards part 150 due to the biasing force generated between biasing mechanism 160 and stiffener 190 and the tolerance between biasing mechanism 160 and stiffener 190 (e.g., by distance D). Therefore, part 150 may include one or more indents in the bottom surface of body 150*b* for receiving the free end portion of a respective biasing feature when deflected therein. For example, as shown, part 150 may include a first indent 155 in the bottom surface of body 150*b* for receiving the free end portion of biasing feature 165 when necessary, and part 150 may include a second indent 157 in the bottom surface of body 150*b* for receiving the free end portion of biasing feature 167 when necessary.

In some embodiments, as shown, a lubricant 166, such as a dry film lubricant, may be provided between biasing mechanism 160 and stiffener 190 and/or slide switch subassembly 180. Lubricant 166 may prevent galling or other degradation between biasing mechanism 160 and stiffener 190 and/or slide switch subassembly 180. For example, top surface 192 of stiffener 190 and biasing features 165 and 167 may each be made of metal (e.g., aluminum or magnesium or zinc), such that lubricant 166 may promote movement of biasing mechanism 160 along stiffener 190 (e.g., along the Y-axis) as slide button subassembly 170 may move along opening 109. By biasing part 150 upwards with respect to stiffener 190 and/or slide switch subassembly 180 in the +X-direction, biasing mechanism 160 may also allow for the engagement between switch 184 and molded part 150 to be primarily, if not entirely, along the Y-axis. For example, biasing mechanism 160 may bias part 150 upwards in the +X-direction such that no portion of part 150 may engage with a top surface 181 of switch 184 along the X-axis (see, e.g., spacing S of FIG. 5), and such that grips 152 and 158 may provide the sole engagement between part 150 and switch 184 (e.g., along the sides of switch 184) so as to move switch 184 along the Y-axis.

Figure 3:
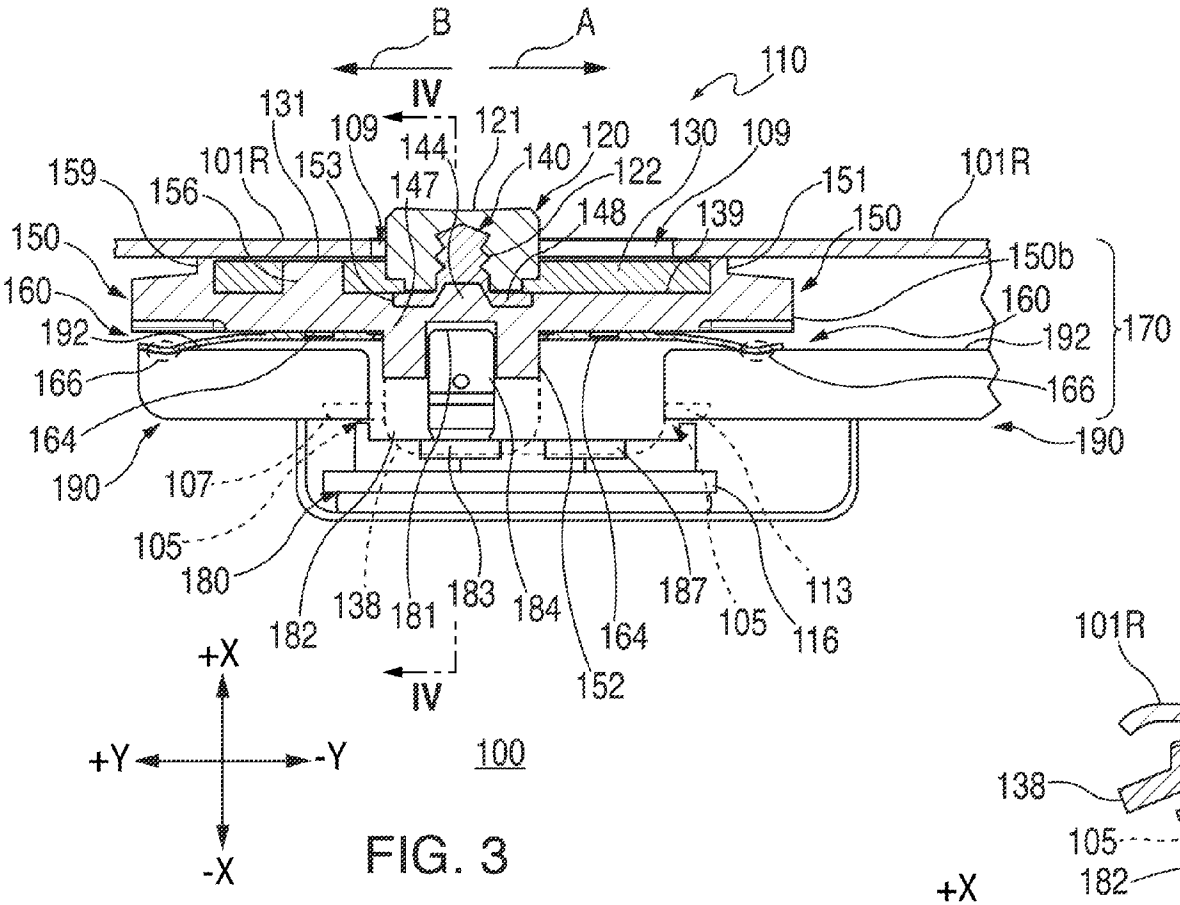
FIG. 3 is a cross-sectional view of a slide input component assembly of the electronic device of FIGS. 1 and 2, taken from line III-III of FIG. 2, with the slide input component assembly in a first stage of actuation, in accordance with some embodiments of the invention.
Figure 4:
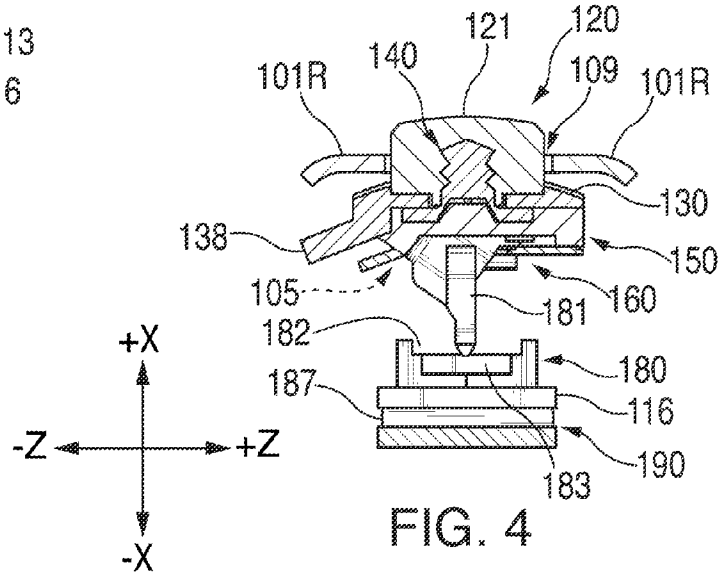
FIG. 4 is a cross-sectional view of the slide input component assembly of FIGS. 1-3, taken from line IV-IV of FIG. 3, in accordance with some embodiments of the invention.

In some embodiments, one or more features of device 100 (e.g., one or more features of housing 101) may interact with tab 138 of base 130 for limiting the movement of slide button subassembly 170 along the Y-axis. For example, as shown in FIGS. 3, 5, and 15, a recess 105 extending between a first end 107 and a second end 113 may be provided within device 100, such as within a portion of housing 101 (e.g., within an interior surface of right wall 101R). When slide button subassembly 170 is properly positioned within device 100 such that knob 120 may be exposed through opening 109, tab 138 of base 130 may at least partially extend within recess 105. In some embodiments, tab 138 may be configured to engage (e.g., physically abut or interact with) first end 107 of recess 105 when knob 120 and the remainder of slide button subassembly 170 is in its first functional position of FIGS. 3, 4, 14, and 15, such that the engagement of tab 138 with first end 107 of recess 105 may prevent movement of tab 138 and the remainder of slide button subassembly 170 in the direction of arrow B from its first functional position of FIGS. 3, 4, 14, and 15. Similarly, tab 138 may be configured to engage (e.g., physically abut or interact with) second end 113 of recess 105 when knob 120 and the remainder of slide button subassembly 170 is in its second functional position of FIG. 5, such that the engagement of tab 138 with second end 113 of recess 105 may prevent movement of tab 138 and the remainder of slide button subassembly 170 in the direction of arrow A from its second functional position of FIG. 5. In some embodiments, recess 105 may be formed by a similar process as the formation of opening 109 and/or recess 105 may be formed during the formation of opening 109. For example, opening 109 and recess 105 may each be formed by CNC machining. Therefore, recess 105 and opening 109 may be accurately spaced and shaped with respect to each other, such that recess 105 may be well suited to limit the movement of slide button subassembly 170 with respect to opening 109. In some embodiments, only the engagement between tab 138 and recess 105 may terminate movement of subassembly 170 along the Y-axis of opening 109. That is, no other interaction between any other portion of assembly 170 and/or 110 with any other portion of device 100 may be the limiting interaction of the movement of assembly 170 along opening 109.

Figure 17:
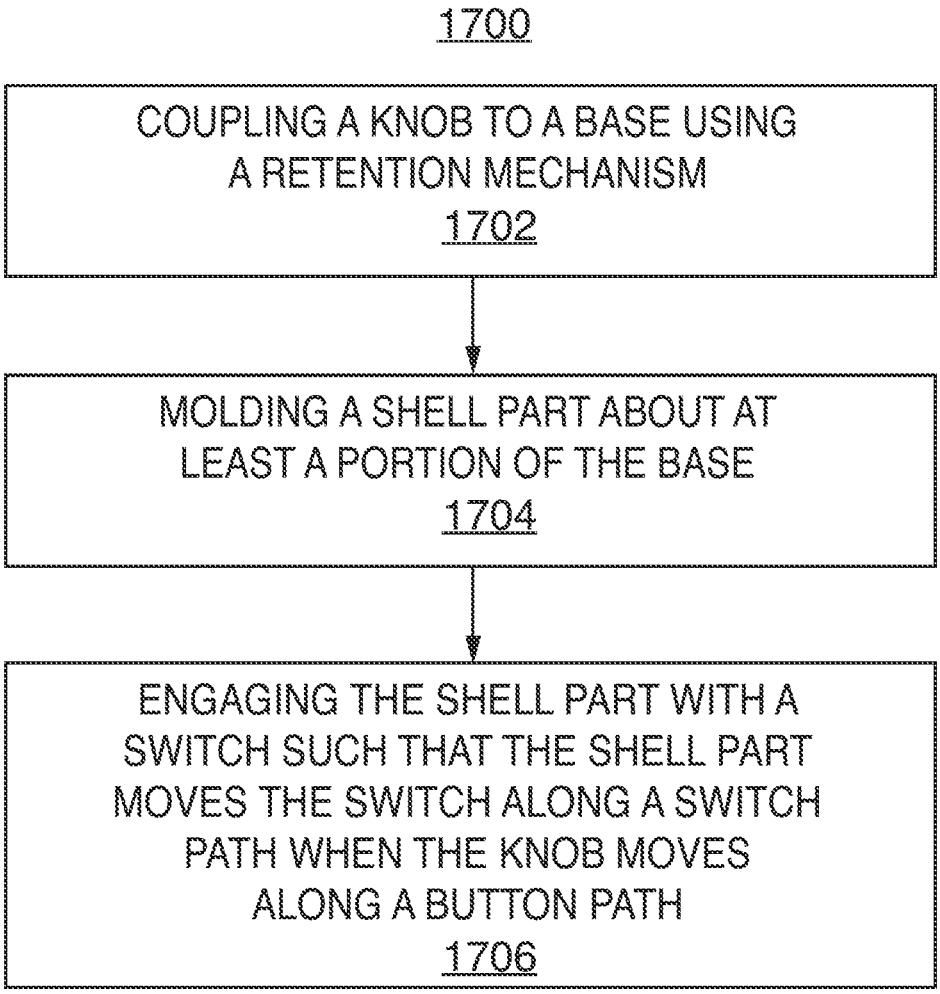
FIG. 17 is a flowchart of an illustrative process for assembling a slide input component assembly of an electronic device, in accordance with some embodiments of the invention.

FIG. 17 is a flowchart of an illustrative process 1700 for assembling a slide input component assembly of an electronic device (e.g., slide input component assembly 110 of electronic device 100). Step 1702 of process 1700 may include coupling a knob to a base using a retention mechanism (e.g., coupling knob 120 to base 130 using retention mechanism 140). Next, step 1704 of process 1700 may include molding a shell part about at least a portion of the base (e.g., molding part 150 about at least a portion of base 130). Next, step 1706 of process 1700 may include engaging the shell part with a switch such that the shell part moves the switch along a switch path when the knob moves along a button path (e.g., engaging part 150 with switch 184 such that part 150 moves switch 184 along switch path 182 when knob 120 moves along opening 109). In some embodiments, the coupling of step 1702 may include engaging the knob with the retention mechanism (e.g., engaging knob retention feature 122 with retention mechanism 140) and retaining a portion of the base between the knob and the retention mechanism (e.g., retaining mid-surface 135 of main body portion 133 of base 130 between main body portion 124 of knob 120 and head body portion 148 of retention mechanism 140). In some other embodiments, the coupling of step 1702 may include gluing the knob to the base (e.g., gluing knob 120 to base 130 with retention mechanism 140). In some embodiments, the molding of step 1704 may prevent the retention mechanism from disengaging or rotating with respect to the knob (e.g., molded part features 154 of part 150 within retention features 144 of retention mechanism 140 may prevent any rotation of retention mechanism 140 that may allow retention mechanism 140 to disengage from retention features 122 of knob 120). In some embodiments, process 1700 may also include biasing the shell part away from the switch in at least one direction using a spring (e.g., biasing part 150 away from switch 184 with biasing mechanism 160).

It is to be understood that the steps shown in process 1700 of FIG. 17 are merely illustrative and that existing steps may be modified or omitted, additional steps may be added, and the order of certain steps may be altered.

While there have been described slide input component assemblies of an electronic device and methods for making the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up and "down," "front" and "back," "top" and "bottom" and "side," "length" and "width" and "thickness," "X-" and "Y-" and "Z-," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Moreover, an electronic device constructed in accordance with the principles of the invention may be of any suitable three-dimensional shape, including, but not limited to, a sphere, cone, octahedron, or combination thereof, rather than a hexahedron, as illustrated by FIGS. 1-16.

Therefore, those skilled in the art will appreciate that the invention can be practiced by other than the described embodiments, which are presented for purposes of illustration rather than of limitation.

What is claimed is:

1. An input component assembly comprising:
a slide button subassembly comprising:
a knob configured to protrude along an axial direction;
a shell part;
a base between the knob and the shell part; and
a retention mechanism that couples the knob to the base; wherein
the shell part comprises a portion extending above a surface of the base and configured to slidably engage an interior surface of a housing of an electronic device; and
a slide switch subassembly comprising a switch that is configured to be moved along a switch path when the slide button subassembly slides, relative to the housing of the electronic device, along a button path perpendicular to the axial direction.

2. The input component assembly of claim 1, wherein:
the retention mechanism engages the knob; and
the retention mechanism retains a portion of the base between the knob and the retention mechanism.

3. The input component assembly of claim 1, wherein the retention mechanism comprises a screw.

4. The input component assembly of claim 1, wherein the retention mechanism comprises glue.

5. The input component assembly of claim 1, wherein the shell part receives at least a portion of the retention mechanism.

6. The input component assembly of claim 1, wherein:
the retention mechanism comprises a screw; and
the shell part is provided within a drive design feature of the screw.

7. The input component assembly of claim 6, wherein the shell part provided within the drive design feature of the screw prevents the screw from disengaging from the knob.

8. The input component assembly of claim 1, further comprising a biasing mechanism that biases the slide button subassembly away from the slide switch subassembly in at least one direction.

9. The input component assembly of claim 8, wherein the biasing mechanism is coupled to the shell part.

10. The input component assembly of claim 8, wherein the shell part comprises a recess that receives a free end of the biasing mechanism.

11. The input component assembly of claim 8, wherein the biasing mechanism comprises a spring.

12. The electronic device of claim 1, wherein:
the base is metal; and
the shell part is plastic.

13. The input component assembly of claim 1, wherein the knob extends at least partially through an aperture of the housing of the electronic device.

14. The input component assembly of claim 1, wherein the knob, the base, the retention mechanism, and the shell part are fixed relative to one another at least in a direction parallel to the button path.

15. The input component assembly of claim 1, wherein the portion of the shell part extending above the surface of the base protrudes above the surface of the base along the axial direction.

16. The input component assembly of claim 1, wherein the portion of the shell part extending above the surface of the base prevents the base from contacting the interior surface of the housing of the electronic device.

17. An electronic device comprising:
a housing comprising an opening therethrough;
a recess formed into an internal portion of the housing;
an input component assembly comprising:
a slide button subassembly comprising:
a base comprising a tab;
a knob coupled to the base; and
a shell part provided about at least a portion of the base; and
a slide switch subassembly comprising a switch that is configured to move along a switch path when the knob moves along the opening, wherein:
the tab moves along the recess when the knob moves along the opening; and
the tab interacts with the recess to limit the movement of the knob along the opening.

18. An electronic device, comprising:
a housing comprising a first opening therethrough;

a knob having a main body portion that includes a first surface that extends through the first opening and an opposing second surface that includes a retention feature;

a base having a second opening therethrough;

a retention mechanism that couples the knob to the base, wherein the retention mechanism includes a main body portion that partially extends through the second opening in the base and couples to the retention feature on the second surface of the knob; and a shell part comprising:

a first overhang and a second overhang that extend from a first surface of the shell part, wherein the first and second overhangs are configured to retain the base between the first and second overhangs; and a first switch grip and a second switch grip that extend from a second surface of the shell part, wherein the first and second switch grips are configured to slide a switch along a switch path when the knob slides along the first opening in the housing.

19. The electronic device as in claim 18, wherein the retention mechanism comprises a head body portion having a first surface that is coupled to the main body portion and a second opposing surface that includes a drive design feature, wherein the first surface of the head body portion is adjacent a bottom surface of the base when the retention mechanism couples the knob to the base.

20. The electronic device as in claim 19, wherein the shell part comprises at least one feature on the first surface of the shell part that is configured to engage with the drive design feature in the second surface of the head body portion of the retention mechanism.

21. The electronic device as in claim 18, further comprising a biasing mechanism coupled to the second surface of the shell part, wherein the biasing mechanism is configured to bias the shell part towards the housing and the first opening.

22. The electronic device as in claim 18, wherein the base comprises an indicator opening therethrough; and the shell part comprises an indicator portion that extends from the first surface of the shell part and is configured to extend through the indicator opening to be exposed through the first opening when the knob slides along the first opening from a first functional position to a second functional position.

23. An input component assembly, comprising:

a knob having a main body portion that includes a first surface that is configured to extend through an opening of a housing of an electronic device; and a shell part mechanically engaged with the knob, the shell part comprising:

a first overhang and a second overhang that extend from a first surface of the shell part, wherein the first and second overhangs are configured to retain the knob between the first and second overhangs, and to slideably engage with an interior surface of the housing of the electronic device; and a first switch grip and a second switch grip that extend from a second surface of the shell part, wherein the first and second switch grips are configured to slide a switch along a switch path when the knob slides along the first opening in the housing.

24. The input component assembly of claim 23, wherein the shell part provided within the drive design feature of the screw inhibits the screw from rotating with respect to the shell part.

25. The input component assembly of claim 24, wherein the shell part provided within the drive design feature of the screw inhibits the screw from unthreading from the knob.

26. The input component assembly of claim 24, wherein the base includes a feature that inhibits rotation of the knob with respect to the base.

27. The input component assembly of claim 24, wherein the knob includes a noncircular body portion, the base includes a non-circular opening therethrough configured to receive the non-circular body portion, and the non-circular opening is configured to inhibit rotation of the knob with respect to the base.

* * * * *